US005667655A

United States Patent [19]

Libman et al.

[11] Patent Number: 5,667,655

[45] Date of Patent: Sep. 16, 1997

[54] METHOD OF MAKING COLOR SCREENS FOR FED AND OTHER CATHODOLUMINSCENT DISPLAYS

[75] Inventors: Philomena C. Libman, Arlington Heights; Felix E. Tello, Tinley Park, both of Ill.

[73] Assignee: Zenith Electronics Corporation, Glenview, Ill.

[21] Appl. No.: 633,914

[22] Filed: Apr. 15, 1996

[51] Int. Cl.[6] ..... C25D 13/04; H01J 29/32

[52] U.S. Cl. ..... 204/485; 204/486; 205/122; 427/68; 430/7; 430/23; 430/25

[58] Field of Search ..... 205/122; 204/484, 204/485, 486; 427/64, 68; 430/7, 23, 25

[56] References Cited

U.S. PATENT DOCUMENTS

| | | | |
|---|---|---|---|
| Re. 23,360 | 3/1951 | Evans et al. | 358/56 |
| 3,314,871 | 4/1967 | Heck et al. | 204/181 |
| 3,360,450 | 12/1967 | Hays | 204/181 |
| 3,475,169 | 10/1969 | Lange | 96/1 |
| 3,554,889 | 1/1971 | Hyman et al. | 204/181 |
| 3,632,339 | 1/1972 | Khan | 96/36.1 |
| 3,681,222 | 8/1972 | Gupton, Jr. | 204/181 |
| 3,681,223 | 8/1972 | Gupton, Jr. | 204/181 |
| 3,830,722 | 8/1974 | Rehkopf et al. | 204/299 |
| 3,858,081 | 12/1974 | Rehkopf et al. | 313/467 |
| 3,904,502 | 9/1975 | Phillips | 204/181 |
| 3,914,634 | 10/1975 | Overall et al. | 313/105 |
| 4,070,596 | 1/1978 | Tsuneta et al. | 313/408 |
| 4,130,472 | 12/1978 | Kaplan et al. | 204/181 N |
| 4,341,591 | 7/1982 | Tamutus | 156/630 |
| 4,617,094 | 10/1986 | Kamamori et al. | 204/18.1 |
| 5,122,708 | 6/1992 | Donofrio | 313/470 |
| 5,340,673 | 8/1994 | Tateyama et al. | 430/23 |
| 5,466,358 | 11/1995 | Kiyomiya et al. | 205/96 |

FOREIGN PATENT DOCUMENTS

| | | | |
|---|---|---|---|
| 964713 | 3/1975 | Canada | 313/41 |
| 2107039 | 4/1972 | France . | |
| 3012993 | 10/1981 | Germany . | |
| 1242999 | 8/1971 | Netherlands . | |
| 509616 | 6/1971 | Switzerland . | |

*Primary Examiner*—Kathryn L. Gorgos
*Assistant Examiner*—William T. Leader
*Attorney, Agent, or Firm*—John Coult; Roland Norris

[57] ABSTRACT

A method for use in the construction of a color display screen using deposition of a plurality of electroluminescent materials onto a substrate bearing said screen. The method comprises the forming operations a), b), and c) in any sequence: a) forming on the substrate a first pattern of deposition sites covered with a first material selectively strippable by a first agent; b) forming on the substrate a second pattern of deposition sites covered with a second material strippable by a second agent but not significantly attacked by said first agent; and c) forming on the substrate a matrix surrounding the first and second patterns of deposition sites. The method includes thereafter performing a first stripping of the first material with the first agent to reveal first deposition sites within the matrix and performing a first depositing of a first electroluminescent material within the first revealed deposition sites. Following the first stripping and depositing, the second material is stripped with the second agent to reveal second deposition sites within the matrix and a second electroluminescent material is deposited within the second revealed deposition sites. By the practice of the disclosed method the forming operations are segregated from the electroluminescent material depositing operations.

27 Claims, 4 Drawing Sheets

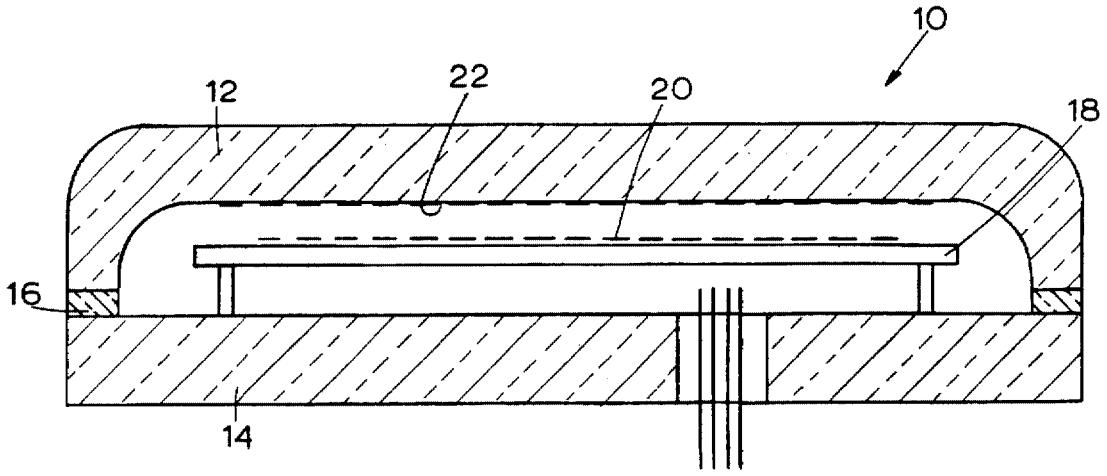
FIG. 1 PRIOR ART
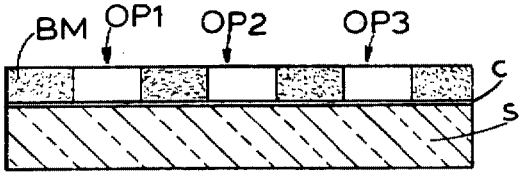
FIG. 2A
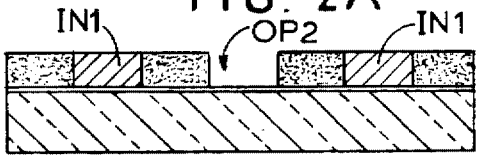
FIG. 2B
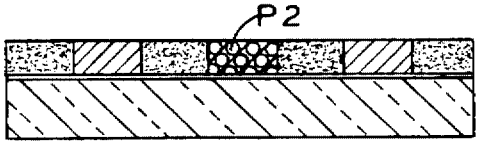
FIG. 3
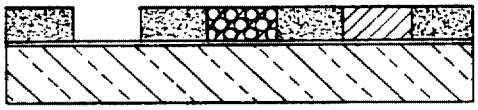
FIG. 4
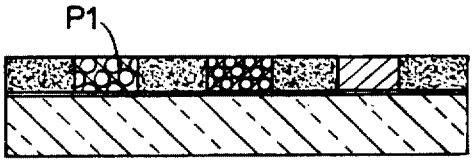
FIG. 5
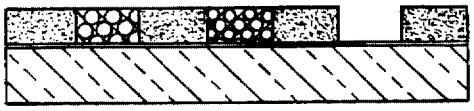
FIG. 6
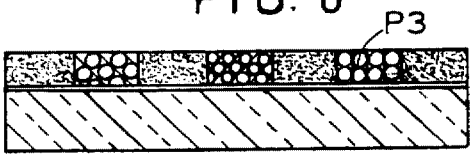
FIG. 7
FIGs 2A-7
PRIOR ART

METHOD OF MAKING COLOR SCREENS FOR FED AND OTHER CATHODOLUMINSCENT DISPLAYS

BACKGROUND OF THE INVENTION

This invention relates to a method useful in the manufacture of field emission cathode displays ("FEDs") and other cathodoluminescent color displays of a type utilizing a color screen comprising interregistered patterns of red-light-emitting, blue-light-emitting, and green-light-emitting phosphor elements (hereinafter sometimes termed "red", "blue", and "green" phosphor elements).

FIG. 1 schematically depicts an FED display 10 of a type which may embody a screen made according to the teachings of the present invention. The display 10 comprises a glass front panel 12 and a glass rear panel 14 which are joined by a glass frit cement 16. A field emitter array 18 supports a large number of field emitters which produce electron beams accelerated through control grid 20 to excite a color phosphor screen 22.

In the fabrication of such screens, the patterns of red, blue and green phosphor elements in each pattern, and each pattern relative to the other two patterns, must be laid down with extreme precision.

U.S. Pat. No. 4,891,110 describes and claims a process for depositing by electrodeposition a sequence of interregistered red, blue and green phosphor patterns. As used herein, "electrodeposition" or "electrodepositing" refers to cataphoretic or other processes utilizing a bath from which a material is deposited on an electrically charged substrate under the influence of fields created between the substrate and another electrode.

Reference may be had to FIGS. 2A–7 wherein the method of the '110 patent is illustrated schematically. In FIGS. 2A–7, substrate "S" supports a conductor "C".

The process of the '110 patent comprises forming an electrically insulative black matrix BM—sometimes termed a "black grille" or "black surround"—having formed therein first, second and third patterns of openings (OP1, OP2, OP3) corresponding to the patterns of the red, blue and green phosphor elements (FIG. 2A). The first and third patterns of openings, are then, in effect, plugged with an insulative material IN1 (FIG. 2B). A second pattern of phosphor elements P2 is cataphoretically deposited in the second pattern of openings onto the underlying substrate (FIG. 3). The first pattern of openings is then unplugged (FIG. 4) and the first pattern of phosphor elements P1 is cataphoretically deposited in the first pattern of openings (FIG. 5). The third pattern of openings is then unplugged (FIG. 6) and the third pattern of phosphor elements P3 is electrodeposited in the third pattern of openings (FIG. 7).

The three patterns of openings in the electrically insulative black matrix are formed photographically using a set of photomasters through which exposures are made. The aforedescribed plugging of the first and third patterns of openings is accomplished using photomasters which are interregistered with the photomaster used to form the composite pattern of openings in the black matrix. This assures that the plugs are accurately placed in the patterns of openings. Kinematic fixturing techniques, or other techniques well known in the art, are used to assure interregistration of the various photomasters which are used in the described processes.

While the screening process described and claimed in the '110 patent is viable, it requires an exposure step between certain phosphor electrodeposition steps.

Specifically, after the aforediscussed second pattern of phosphor elements is cataphoretically deposited in the second pattern of openings, the first pattern of openings is selectively unplugged. This is accomplished by stripping the plugs from the first and third patterns of openings, and then replugging the third pattern of openings.

The interruption of the electrodeposition operation by a photoexposure step creates a number of difficulties.

As the fixture employed to carry the substrate during the first photolithographic plugging operation cannot travel with the substrate through the electrodeposition bath, it must be detached and another fixture reattached for the exposure step comprising part of the second plugging operation.

However, a need to disassemble and reassemble the fixture and substrate, as a practical matter, eliminates the possibility of obtaining the very high tolerances associated with high resolution FED screens using cost-effective mechanical fixturing techniques. The plugging operation involves coating the screen with a photosensitive material and exposing the material to light actinic to the material in areas which corresponds to the third pattern of openings. After development, the substrate has the first pattern of openings open and the third pattern of openings plugged, permitting electrodeposition of a pattern of phosphor elements into the first pattern of openings.

Finally, the plugs are stripped from the third pattern of openings and the third pattern of phosphor elements is electrodeposited into the third pattern of openings, completing the phosphor deposition process.

Thus, it will be seen that the electrodeposition operations of the '110 patent are interrupted by an exposure step.

To reiterate, it is imperative that each phosphor pattern be interregistered precisely with the remaining two phosphor patterns. If mechanical registration techniques are employed so as to achieve manufacturing economies, the registration fixture mated with a particular screen-supporting substrate must be mechanically coupled to the substrate throughout all photoexposure steps. As noted, this need for uninterrupted mating of fixture and substrate through all exposure steps cannot be satisfied using the method of the '110 patent. This means that more costly optical registration techniques must be employed.

The process of the '110 patent thus renders impracticable process and physical segregation of the exposure operations from the electrodeposition operations. These burdens imposed on the achievement of the necessary interpattern registration, and the inability to segregate the exposure and electrodeposition operations, translates into added cost of manufacture.

OBJECTS OF THE INVENTION

It is an object of this invention to provide a method which is useful in the manufacture of screens for FEDs and other cathodoluminescent color display devices of a type which comprise interregistered patterns of red, blue and green phosphor elements.

It is another object of this invention to provide in the manufacture of such screens an improved method of electrodepositing a sequence of patterns of red, blue and green phosphor elements.

It is yet another object of this invention to provide a method of electrodepositing a sequence of interregistered patterns of phosphor elements which involves a series of exposure and development operations and a series of phosphor electrodeposition operations, the method being characterized by having the photoexposure and electrodeposition operations segregated, making possible significantly lower cost of manufacture of the resulting screens.

It is still another object to provide such a method which, when used with manganous carbonate as a black matrix material, does not result in loss of phosphor emission upon electron stimulation.

Other Related Art

U.S. Pat. No. 3,314,871
U.S. Pat. No. 3,360,450
U.S. Pat. No. 3,475,169
U.S. Pat. No. 3,554,889
U.S. Pat. No. 3,632,339
U.S. Pat. No. 3,681,222
U.S. Pat. No. 3,681,223
U.S. Pat. No. 3,904,502
U.S. Pat. No. 3,914,634
U.S. Pat. No. 4,070,596
U.S. Pat. No. 4,130,472
U.S. Pat. No. 4,617,094
U.S. Pat. No. 5,466,358
Canadian Patent No. 964,713
United Kingdom 1,242,999
CH-A-509,616
DE-A-3,012,993
FR-A-2,107,039
U.S. Pat. No. 3,554,889
U.S. Pat. No. 3,830,722
U.S. Pat. No. 3,858,081
U.S. Pat. No. 4,341,591
US-E-28360

DESCRIPTION OF THE FIGURES

FIG. 1 is a schematic illustration of an FED display of a type which may embody a screen made according to the teachings of the present invention;

FIGS. 2A–7 are schematic diagrams depicting the color screen fabrication method disclosed in U.S. Pat. No. 4,891,110;

DESCRIPTION OF THE PREFERRED EMBODIMENTS

The present invention is useful in the manufacture of color screens for field emission cathode displays and other or electroluminescent displays. Specifically, the invention concerns a method for use in the construction of a color display screen using deposition of a plurality of electroluminescent materials onto a substrate bearing the screen, the method comprising the forming operations a), b) and c) in any sequence, followed by operations d) and e): a) forming on the substrate a first screening pattern of deposition sites covered with a first material selectively strippable by a first agent, b) forming on the substrate a second pattern of deposition sites covered with a second material strippable by a second agent but not significantly attacked by said first agent, c) forming on the substrate a matrix surrounding the first and second patterns of deposition sites, and thereafter, d) performing a first stripping of the first material with the first agent to reveal first deposition sites within said matrix and performing a first depositing of a first electroluminescent material within the first revealed deposition sites, and following the first stripping and depositing: e) stripping the second material with the second agent to reveal second deposition sites within the matrix and depositing a second electroluminescent material within the second revealed deposition sites. By the method of the invention, the forming operations are segregated from the electroluminescent material depositing operations.

It will become clear from the following description, in the practice of the method of this invention, whereas electrodeposition is described as the preferred method of depositing certain materials, conventional photolithographic techniques may be employed for depositing such materials in prescribed patterns.

As used herein, the term "electroluminescent" is intended to refer to the direct conversion of electrical energy into light.

In a preferred execution of the method of the present invention, the electroluminiscent displays are cathodoluminescent, employing phosphors as the light emitting material. Three patterns of phosphor elements are deposited, preferably by cathaphoresis or other electrodeposition processes. A preferred execution of the method of the present invention concerns the fabrication of a color screen comprising at least first and second, and preferably first, second and third interregistered patterns of phosphor elements supported on an electrically conductive surface of a transparent substrate. See FIGS. 8–15.

Figure 8:
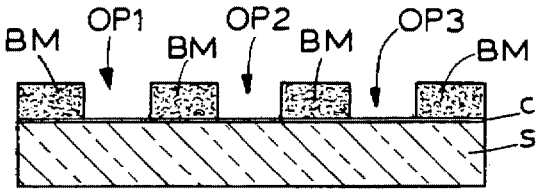
FIGS. 8–15 are schematic diagrams depicting the preferred execution of the color screen fabrication method of the present invention.

The process begins with a substrate S which supports an electrical conductor C and which has an electrically insulative layer BM over the conductive surface with first, second and third sets of interregistered sets of openings OP1, OP2, OP3 exposing the substrate. The first, second and third sets of openings correspond to the first, second and third sets of phosphor elements (FIG. 8).

Figure 9:
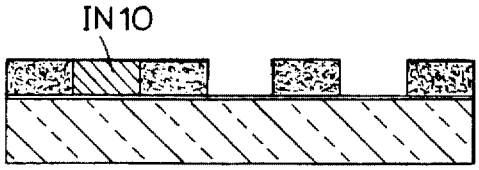
Figure 10:
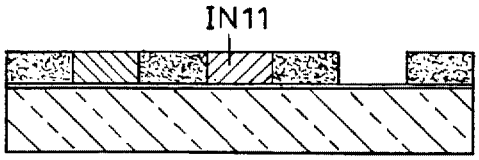

The preferred execution of the method of the present invention comprises photolithographically plugging the first set of openings OP1 with a first electrically insulative material IN10 removable by application of a first stripping agent (FIG. 9). The second set of openings OP2 is photolithographically plugged with a second electrically insulative material IN11 which is removable by application of a second stripping agent (FIG. 10).

Figure 11:
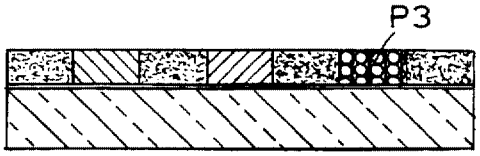
Figure 12:
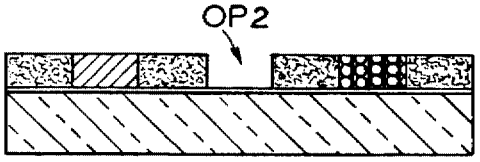
Figure 13:
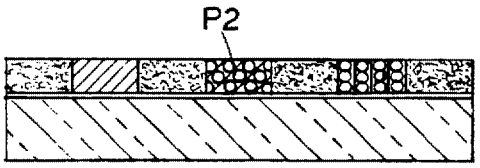

After the said plugging operations, the third pattern of phosphor elements P3 is electrodeposited onto the substrate through the third set of openings OP3 (FIG. 11). The second electrically insulative material IN11 is removed from the second set of openings OP2 by application of the second stripping agent (FIG. 12). The second pattern of phosphor elements P2 is electrodeposited onto the substrate through the second set of openings OP2 (FIG. 13).

Figure 14:
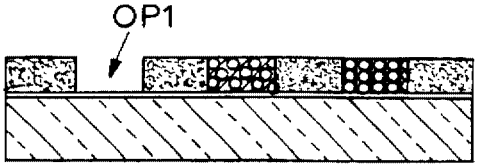
Figure 15:
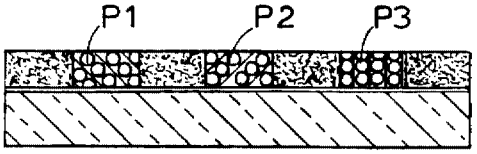

The first electrically insulative material IN10 is removed from the first set of openings OP1 by application of the first stripping agent (FIG. 14). Finally, the first pattern of phosphor elements P1 is electrodeposited onto the substrate through the first set of openings (FIG. 15).

Alternatively, the first insulative IN10 material may be stripped before the second insulative material IN11 is stripped. Further, as will become evident hereinafter, the layer BM may be deposited after or intermediate the plugging operations.

It will thus be seen that in the described execution of the method of this invention the process operation involving photolithography (which include photoexposure steps) are segregated from the phosphor electrodeposition operation.

As used herein, the term "photolithography" or "photolithographic" means any process in which a layer of photosensitive material is exposed to radiation actinic to the layer, and the layer is developed to form a pattern.

The process of the invention employs electrodeposition techniques for depositing the phosphor elements. Electrodeposition processes have been found to be particularly useful in fabricating high resolution screens for FEDs and the like, as smaller phosphor particles can be laid down in finer patterns by electrodeposition than is practicable with conventional slurry techniques.

The preferred execution of this invention is a modification of a process described and claimed in U.S. Pat. No. 4,891,110, assigned to the assignee of the present invention. A number of the method steps employed in the fabrication of color screens according to the present invention may be the same as those described in the '110 patent.

As noted in the Background of the Invention of this application, the method described in the '110 patent is characterized by having the electrodeposition processes for successively depositing the three patterns of phosphor elements as being interrupted by a photoexposure step associated with plugging or closing of a set of openings in the black matrix.

As will be described in detail hereinafter, the present invention is characterized by a segregation of the photoexposure steps from the electrodeposition steps, with the attendant benefits and advantages heretofore described.

Again referring to FIGS. 8–15, in accordance with a preferred form of the present invention, there is formed on an electrically conductive surface C of a substrate a layer BM with first, second and third patterns of interregistered sets of openings OP1, OP2, OP3 exposing the substrates. The layer BM is electrically insulative, or is subsequently caused to be electrically insulative if initially conductive. In a preferred application of the present method to the fabrication of cathodoluminesent color screens, the substrate S is composed of transparent glass. While the invention contemplates the use of conductive glass, for cost reasons the conductive surface preferably comprises a transparent conductive layer C on conventional non-conductive glass. The transparent conductive layer C may be composed of indium tin oxide or other suitable material. Being transparent, such a layer does not have to be removed after the electrodeposition operations are completed.

Alternatively, aluminum or another conductive material which is not transparent to light may be employed. The use of a nontransparent material requires removal after the final electrodeposition step. If aluminum is used, it may be removed, as is well known, by application of a caustic bleach.

As described in the '110 patent, the electrically insulative layer may serve as a black matrix or grille and to that end may be composed of manganous carbonate, cobalt oxide, or other suitable light-absorptive material.

The first, second and third sets of interregistered openings may be formed in the insulative layer by processes described in the '110 patent or other processes well known in the art.

Whereas the '110 patent describes an application wherein the first, second and third sets of openings are formed photolithographically using "center of deflection" printing through an exposure photomaster spaced from the insulative layer, the known techniques of near contact printing or contact printing are more suitable for use in high resolution FED screens and other high resolution cathodoluminescent screens. Alternatively, if the insulative material is sufficiently light absorptive, conventional back exposure techniques (exposing from the viewed side) may be employed. Following the teachings of the '110 patent, an insulative layer BM is formed which has three sets of openings OP1, OP2, OP3 corresponding to the sum of the red, blue and green phosphor element patterns.

To avoid interruption of the phosphor electrodeposition processes by an exposure operation, the method of the preferred form of the present invention involves plugging a first set of the grille openings with a first electrically insulative material which is removable by application of a stripping first agent, and plugging a second set of the openings with a second electrically insulative material which is removable by application of a second stripping agent but is not significantly attacked by the first agent.

The use of this selective stripping technique permits one set of openings to be unplugged to bare the substrate for electrodeposition of a pattern of phosphor elements, and then, without the need for any additional exposure operations, unplugging the other set of openings for electrodeposition of a second pattern of phosphor elements.

In more detail, the first set of openings OP1 may be closed or "plugged" (FIG. 9) by a photolithographic process such as described in the '110 patent, utilizing as the first selectively strippable insulative material PVA (polyvinyl alcohol) photosensitized with DIAZO RESIN NO. 4 photoresist. DIAZO RESIN No. 4 is a trade name of Fairmont Chemical Co. of Newark, N.J., and has the chemical description 4-(phenylamino)-benzenediazonium sulfate (1:1) formaldehyde polymer, zinc chloride complex. The PVA/DIAZO RESIN No. 4 photoresist formulation may be as follows: 600 grams PVA Type 523 (Air Products), 10% solution; 900 ml. deionized water; 30 grams DIAZO RESIN No. 4 photoresist, 10% solution; PVA/DIAZO RESIN No. 4 photoresist concentration - 20:1. The pH of the DIAZO RESIN No. 4 photoresist solution is preferably adjusted to 7.0 with a 2.5% solution of ammonium hydroxide.

The second set of openings OP2 is closed or "plugged" (FIG. 10) by a photolithographic process such as described in the '110 patent, using a second electrically insulative material IN11 which may, e.g., comprise PVA photosensitized with sodium dichromate, potassium dichromate, or ammonium dichromate. The following PVA/ammonium dichromate formulation may be employed: 600 grams PVA Type 523 (Air Products), 10% solution; 900 ml. deionized water, 85.6 grams ammonium dichromate, 10% solution. The PVA/dichromate and PVA/diazo No. 4, each being electrically insulative, assures that no phosphor cross-contamination will occur during the electrodeposition steps.

Returning to a more general description of the method according to the present invention-as noted, the first set of openings OP1 may be closed with plugs of PVA/DIAZO RESIN No. 4 photoresist. This is accomplished by coating the screen with the PVA/DIAZO RESIN No. 4 photoresist material, drying the screen, and then exposing it through a first exposure photomaster. As it is imperative that the first, second and third sets of openings OP1, OP2, OP3 in the insulative layer BM be interregistered with the patterns of phosphor elements, the first photomaster is desirably interregistrable with the photomaster means employed to form the first, second and third sets of openings in the insulative layer.

In the preferred process employing PVA/DIAZO RESIN No. 4 photoresist, a negative resist, the first exposure photomaster has a pattern of light-transmissive areas corresponding to the first set of openings in the insulative layer, and thus corresponding to the first pattern of phosphor elements. The exposed areas harden to form, in effect, plugs of PVA/DIAZO RESIN No. 4 photoresist in the first pattern of openings (FIG. 9). The substrate is then developed using tap water, with a final wash of deionized water, for example, and dried.

To close the second set of openings OP2, the substrate S is coated with PVA photosensitized with a dichromate, as described. A second exposure photomaster interregistrable with the first exposure photomaster has in the preferred method of this invention, a pattern of light-transmissive areas corresponding to the second set of openings in the insulative layer. The areas of the PVA/dichromate coating impinged by the exposure light harden and, in effect, form plugs IN11 in the second set of openings (FIG. 10). The substrate is then developed by washing with tap water, with a final wash of deionized water, and drying.

It is significant to note at this point in the screen fabrication process that all exposure steps have been completed. As noted, this is a significant departure from the teaching of the '110 patent wherein the subsequent electrodeposition operations must be interrupted by an exposure operation.

Continuing with the description of the method according to this invention, the substrate S now carries an electrically insulative layer having three sets of openings, the first set of which has been closed by a pattern of PVA/DIAZO RESIN No. 4 photoresist plugs IN10, and the second set of which has been closed by a pattern of plugs IN11 comprised of PVA/dichromate (FIG. 10). The third set of openings OP3 provides access to the electrically conductive surface C of the underlying substrate S.

In accordance with techniques described in the '110 patent and otherwise well known methods, the third pattern of phosphor elements P3 (in the described example) is electrodeposited through the third set of openings OP3 onto the bared electrically conductive surface of the underlying substrate (FIG. 11). The electrodeposition process continues until a predetermined deposit thickness has been achieved which, after drying, forms a substantial electrical barrier effective to prevent further electrodeposition. The electrodeposition step may be followed, as is conventional, by an isopropyl alcohol or methanol rinse, and the substrate dried.

To prepare for the next succeeding phosphor electrodeposition step, it is necessary to remove the PVA/dichromate plugs from the second set of openings in the electrically insulative layer (FIG. 12). This may be readily accomplished by the application of a 10% solution of hydrogen peroxide with a pH of 7.0. After rinsing with tap water and deionized water, the second pattern of phosphor elements P2 is electrodeposited through the second set of openings OP2 onto the bared electrically conductive surface of the substrate (FIG. 13). The electrodeposition step may be followed, as is conventional, by an isopropyl alcohol or methanol rinse, and the substrate dried.

To initiate the final phosphor electrodeposition step, it is necessary to remove the PVA/DIAZO RESIN No. 4 photoresist plugs from the first set of openings in the insulative layer (FIG. 14). This may be accomplished by the use of a 2% solution of sodium periodate, or a potassium periodate solution of concentration as low as 0.33% or lower, or another suitable stripping agent. After rinsing with tap water and deionized water, the first set of openings are clear and the first pattern of phosphor elements is deposited onto the substrate (FIG. 15).

The final electrodeposition step may be followed, as is conventional, by an isopropyl alcohol or methanol rinse, and the substrate dried.

Conventional steps may thereafter be employed to complete the processing of the screen. These steps may include application of a binder if necessary, filming, aluminization, and so forth.

Whereas in the preferred embodiment described above, PVA/dichromate and PVA/DIAZO RESIN No. 4 photoresist are employed as the selectively strippable plugging materials, other combinations of plugging material and associated stripping agent may be employed. For example, NPR-6 photoresist by Norland Products, a negative photoresist, may be employed as one plugging material. The NPR-6 photoresist plugs are readily removed by application of a 10% solution of sodium hydroxide. NPR-6 photoresist is a product of Norland Products Inc. of New Brunswick, N.J., and is composed of 13% fish gelatin, 2% ammonium bichromate and 85% water.

In an application of the invention to FEDs and other displays which utilize a thin faceplate and faceplate-supporting structures located in the guardband areas of the screen, it may not be desirable to utilize a black matrix composed of a particulate material such as graphite or manganous carbonate, as the particulate material may not bond sufficiently to the substrate in the regions adjoining the faceplate-supporting structures, resulting in reduced yields due to loose particles. In such applications, it may be desirable to form the black matrix from a suitable non-particulate, light-absorptive material such as evaporated black chrome.

As the process according to this invention requires that the interstitial areas between the phosphor elements be electrically insulative, the insulative photoresist used to form the openings in the black chrome matrix may be retained. The photoresist may be removed after all phosphor patterns are deposited by a final bake-out operation. In other respects, the above-described process according to this invention is unaltered.

In applications wherein the use of a particulate grille is not a concern, one may form a grille with a coating of insulative material such as manganous carbonate, the carbonate is applied over a pattern of PVA/dichromate (or other resist) deposits laid down by a conventional photolithographic process in the areas where phosphor elements will ultimately reside. A suitable stripping agent such as hydrogen peroxide is then used to remove the PVA deposits and the overlying insulative material to thereby form openings corresponding to the sum of the phosphor patterns.

The same basic "lift-off" process may be used where particulates would be a problem if a suitable evaporated light-absorptive material is substituted for the manganous carbonate.

Figure 16:
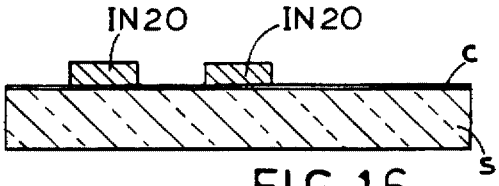
FIGS. 16–25 illustrate an alternate form of the method of the present invention.
Figure 17:
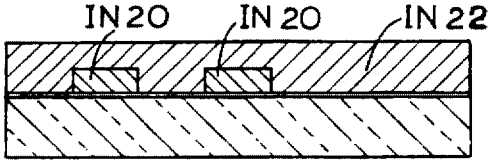
Figure 18:
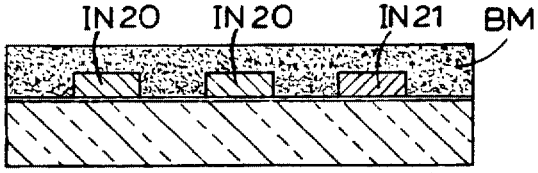

An alternate form of the method of the present invention may then be advantageously utilized, as follows. See FIGS. 16–25. Two patterns of PVA deposits IN20, each sensitized with sodium dichromate, potassium dichromate or ammonium dichromate, for example are deposited and developed (FIG. 16). The substrate S is then coated with a second photoresist material IN22 which is capable of being stripped by a second stripping agent, but not by the stripping agent (hydrogen peroxide for example) for the first and second patterns of PVA/dichromate deposits IN20 (FIG. 17). After exposure and development of the second material IN22, the substrate will contain PVA/dichromate deposits IN20 in the areas where ultimately will be located the patterns of two of the three phosphor elements. The substrate will also contain a third pattern of deposits IN21 composed of the second material IN22—PVA/DIAZO RESIN No. 4 photoresist, for example, which can be selectively stripped by sodium periodate or potassium periodate, e.g., but not by hydrogen peroxide.

Figure 19:
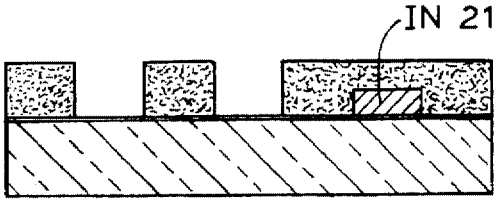
Figure 20:
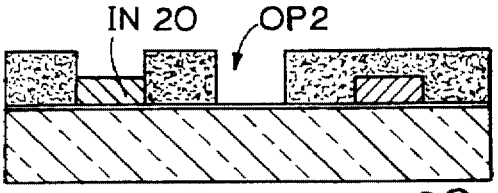

The substrate, with its three patterns, is then coated with an insulative layer BM (manganous carbonate, for example) (FIG. 18), and the two patterns of PVA/dichromate deposits IN20 are stripped, or "popped through" the layer BM, as with a hydrogen peroxide solution (FIG. 19).

Figure 21:
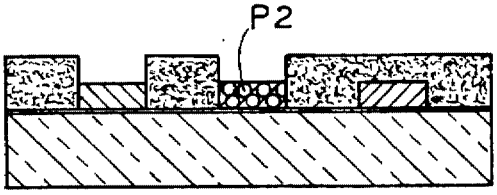
Figure 22:
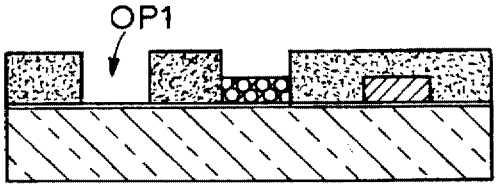

This method of the invention is carried out as described above, with minor modifications. Rather than performing two plugging operations with two selectively strippable materials, followed by a phosphor deposition, in the subject method, one plugging operation will be executed using the said first material IN20, PVA/dichromate for example (FIG. 20), followed by the phosphor electrodeposition step (FIG. 21). Next in the step of applying the second stripping agent to remove the aforesaid second material IN22 (applying sodium or potassium periodate to strip the PVA/DIAZO RESIN No. 4 photoresist, rather than removing plugs of PVA/DIAZO RESIN No. 4 photoresist IN21 from openings in the insulative layer BM, the periodate will be removing the PVA/DIAZO RESIN No. 4 photoresist deposits IN21 formed earlier beneath the insulative layer BM.

Specifically, using photolithographic deposition techniques, openings OP1 are plugged with the first insulative material IN20 (PVA/dichromate) (FIG. 20), followed by electrodeposition of phosphor elements P2 through the openings OP2 onto substrate S (FIG. 21).

Figure 23:
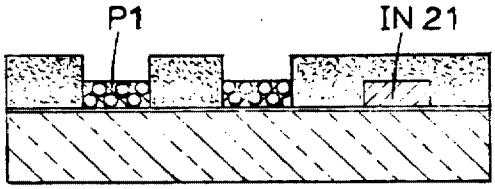

Next, the deposits IN20 of PVA/dichromate are stripped with hydrogen peroxide (FIG. 22), and phosphor elements P1 are deposited through the resulting unplugged openings OP1 onto the substrate S (FIG. 23).

Figure 24:
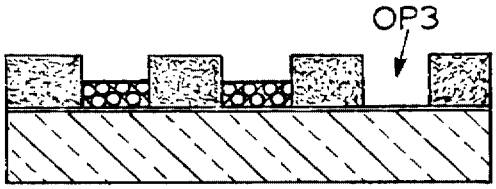

The second selectively strippable material IN21 PVA/DIAZO RESIN No. 4 photoresist in this example) is then stripped (with a periodate), forming a third set of openings OP3 (FIG. 24).

Figure 25:
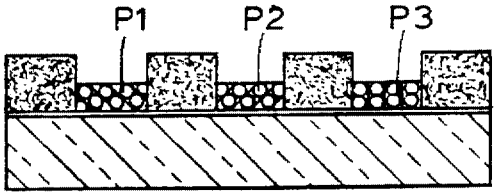

Finally, a third set of phosphor elements P3 is deposited through openings OP3 onto the substrate S (FIG. 25).

Thus, the selective stripping teaching of the present invention remains the same, one difference between this method and that earlier described being that the stripping is of PVA/DIAZO RESIN No. 4 photoresist deposits beneath the insulative layer rather than of deposits located in openings within the insulative layer.

As an alternative to the method described immediately preceding, the insulative material may be electrodeposited on the conductive layer C in the interstitial areas around the deposits of photosensitized resist.

Figure 26:
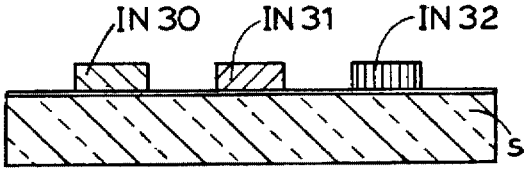
FIGS. 26–33 illustrate another execution of the principles of the present invention.
Figure 27:
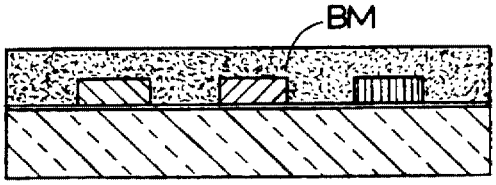

In yet another application of the selective stripping teaching of the present invention (FIGS. 26–33), all operations described heretofore as "plugging" operations may be eliminated and three separately strippable patterns of deposits, one corresponding to each of the phosphor patterns, may be laid down photolithographically on the substrate before the insulative layer is applied. For example, a first pattern of deposits IN30 may be composed of PVA/DIAZO RESIN No. 4 photoresist, a second pattern of deposits IN31 of PVA/dichromate, and a third pattern of selectively strippable deposits IN32 may be composed of NPR-6 photoresist, a negative photoresist which is strippable with a 10% solution of sodium hydroxide (FIG. 26).

After the photolithographic deposition of the patterns of separately strippable deposits, the substrate S is coated with an electrically insulative material BM (FIG. 27), or with a conductive material (such as graphite) which is subsequently coated with an insulator.

In this last-described execution of the method of the invention, after the insulative layer (or electrically conductive layer subsequently rendered insulative) is applied over the three patterns of selectively strippable deposits IN30, IN31, IN32, or around the three patterns of deposits as by the use of electrodeposition techniques, the photolithographic operations have been completed. Thereafter, electrodeposition of the three patterns of phosphor elements is carried out without any further photoexposure steps.

Figure 28:
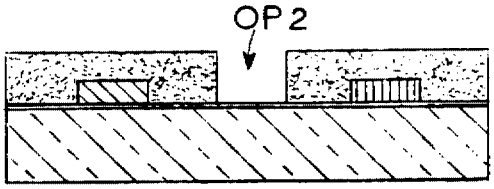
Figure 29:
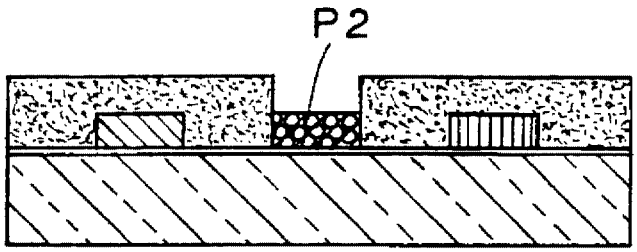

Specifically, the second of the patterns of selectively strippable deposits IN31 (in the preferred method, this is the pattern of PVA/dichromate deposits) is stripped with hydrogen peroxide to form a second set of openings OP2 in the insulative layer BM (FIG. 28). After washing and drying, the second pattern of phosphor elements P2 is electrodeposited through the second set of openings OP2 in the layer BM onto the electrically conductive substrate surface C (FIG. 29).

Figure 30:
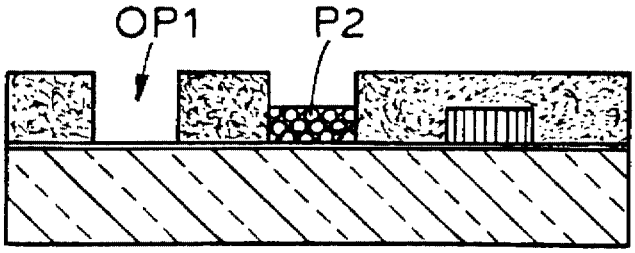
Figure 31:
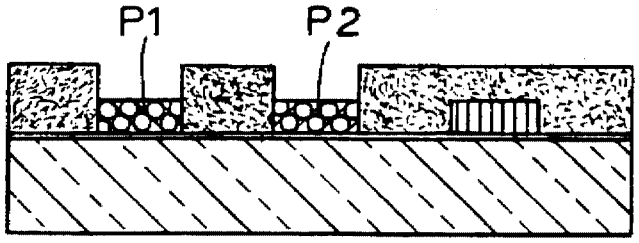

A first set of openings OP1 is formed in the layer by stripping a first of the patterns of deposits IN30 from the BM layer (FIG. 30). In this example, the PVA/DIAZO RESIN No. 4 photoresist deposits IN30 are stripped with a solution of sodium periodate or potassium periodate. After washing and drying, a first pattern of phosphor elements P1 is electrodeposited through the first set of openings OP1 onto the electrically conductive surface of the substrate S (FIG. 31).

Figure 32:
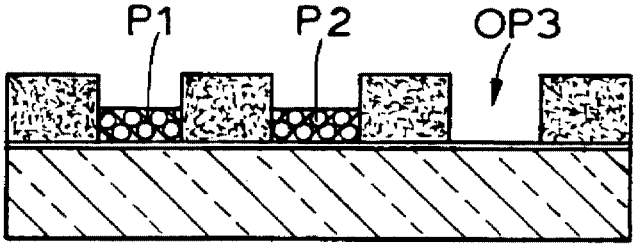
Figure 33:
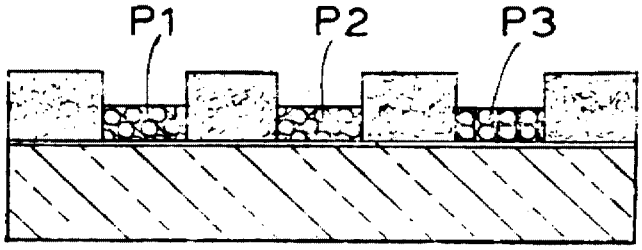

A third and final set of openings OP3 is formed in the overlying insulative layer BM by stripping (with sodium hydroxide) the final set of deposits IN32 (NPR-6 in the described preferred embodiment) (FIG. 32). Finally, the third pattern of phosphor elements P3 is electrodeposited through the insulative layer BM onto the electrically conductive surface of the substrate S (FIG. 3). The use of a layer of graphite as a black matrix or grille has been suggested above. Being a conductor, the layer of graphite must be rendered non-conductive. This can be accomplished before electrodeposition of any active phosphor elements by electrodepositing a white body color nonluminescent phosphor material such as zinc sulfide, zinc silicate or unactivated yttrium trioxide, or other suitable electrodepositable white body color material. Since the electrodeposited material is electrically insulative, it will serve as an electrical barrier during electrodeposition of the patterns of active phosphor elements.

A number of the method examples of the invention described above have suggested the use of manganous carbonate as the insulative layer in an application wherein it is desired to have a black matrix or black surround in the interstitial areas around the patterns of phosphor deposits.

It has also been suggested that one of the selectively strippable photosensitized photoresist materials which may be employed is NPR-6 photoresist. It has further been suggested that the stripping agent which may be used with NPR-6 photoresist is sodium hydroxide. Another application for the use of sodium hydroxide is to remove aluminum if employed as the conductive layer.

However, the presence of manganous carbonate, upon application of sodium hydroxide for use in stripping NPR-6 photoresist or removing an aluminum conductive layer, may establish conditions for a deleterious reaction between the sodium hydroxide and the manganous carbonate. A by-product of a reaction between these materials is manganous oxyhydroxide. Manganous oxyhydroxide may invade the patterns of phosphor deposits and, being light absorptive, may cause a reduced light output from the phosphor deposits when excited by electron bombardment.

One solution to this potential problem is to bake the manganous carbonate to the oxide form of the compound which will not react with sodium hydroxide. However, the requirement for a bake operation increases the expense of the screening operation.

It has been found that if a reducing agent is employed at the time sodium hydroxide is applied, the production of manganous oxyhydroxide will be suppressed. The need for a bake operation to oxidize the manganous carbonate is thus obviated.

A preferred reducing agent is a 0.02% solution of sodium hydrosulfite, preferably from Amway, combined with the sodium hydroxide solution.

It will be recognized that other changes may be made in the process according to the invention, and in the order of the steps described, without departing from the true spirit and scope of the invention herein described and claimed, and it is intended that the description of the inventive process shall be interpreted as illustrative and not in a limiting sense.

We claim:

1. A method for use in the construction of a color display screen using deposition of a plurality of electroluminescent materials onto a substrate bearing said screen, comprising the forming operations a), b), and c) in any sequence, followed by operations d) and e):

a) forming on said substrate a first pattern of deposition sites covered with a first material selectively strippable by a first agent, b) forming on said substrate a second pattern of deposition sites covered with a second material strippable by a second agent but not significantly attacked by said first agent, c) forming on said substrate a matrix surrounding said first and second patterns of deposition sites, and thereafter, d) performing a first stripping of said first material with said first agent to reveal first deposition sites within said matrix and performing a first depositing of a first electroluminescent material within said first revealed deposition sites, and following said first stripping and depositing:

e) stripping said second material with said second agent to reveal second deposition sites within said matrix and depositing a second electroluminescent material within said second revealed deposition sites, whereby the said forming operations are segregated from the electroluminescent material depositing operations.

2. The method according to claim 1 wherein said matrix comprises manganous carbonate.

3. The method according to claim 2 wherein one of said agents comprises sodium hydroxide, and wherein said screen is baked to oxidize said manganous carbonate.

4. The method according to claim 2 wherein one of said agents comprises sodium hydroxide, and wherein sodium hydrosulfite is applied in solution with said sodium hydroxide to temper any effect of said sodium hydroxide to reduce the light output of said electroluminescent materials when stimulated.

5. The method according to claim 1 wherein one of said materials comprises polyvinyl alcohol photosensitized with ammonium dichromate, sodium dichromate or potassium dichromate, and wherein the associated stripping agent comprises hydrogen peroxide.

6. The method according to claim 1 wherein one of said materials comprises polyvinyl alcohol photosensitized with 4-(phenylamino)-benzenediazonium sulfate (1:1) formaldehyde polymer, zinc chloride complex, and wherein the associated stripping agent comprises sodium periodate or potassium periodate.

7. The method according to claim 1 wherein one of said materials is a photoresist composed of 13% fish gelatin, 2% ammonium bichromate and 85% water, and wherein the associated stripping agent comprises sodium hydroxide.

8. The method according to claim 7 wherein sodium hydrosulfite is applied in solution with said sodium hydroxide to temper any effect of said sodium hydroxide to reduce the light output of said electroluminescent materials when stimulated.

9. A method for use in the construction of a color display screen using electrodeposition of a plurality of electroluminescent materials onto a conductive layer on a substrate bearing said screen, comprising the forming operations a), b), and c) in any sequence, followed by operations d) and e):

a) forming on said conductive layer a first pattern of deposition sites covered with a first material selectively strippable by a first agent, b) forming on said conductive layer a second pattern of deposition sites covered with a second material strippable by a second agent but not significantly attacked by said first agent, c) forming on said conductive layer an insulative matrix surrounding said first and second patterns of deposition sites, and thereafter, d) performing a first stripping of said first material with said first agent to reveal first deposition sites within said insulative matrix and performing a first electrodepositing of a first electroluminescent material within said first revealed deposition sites, and following said first stripping and depositing:

e) stripping said second material with said second agent to reveal second deposition sites within said insulative matrix and electrodepositing a second electroluminescent material within said second revealed deposition sites, whereby the said forming operations are segregated from the electroluminescent material electrodepositing operations.

10. The method according to claim 9 wherein said matrix comprises manganous carbonate.

11. The method according to claim 10 wherein one of said agents comprises sodium hydroxide, and wherein said screen is baked to oxidize said manganous carbonate.

12. The method according to claim 10 wherein one of said agents comprises sodium hydroxide and wherein sodium hydrosulfite is applied in solution with said sodium hydroxide to temper any effect of said sodium hydroxide to reduce the light output of said electroluminescent materials when stimulated.

13. The method according to claim 9 wherein one of said materials comprises polyvinyl alcohol photosensitized with ammonium dichromate, sodium dichromate or potassium dichromate, and wherein the associated stripping agent comprises hydrogen peroxide.

14. The method according to claim 9 wherein one of said materials comprises polyvinyl alcohol photosensitized with 4-(phenylamino)-benzenediazonium sulfate (1:1) formaldehyde polymer, zinc chloride complex, and wherein the associated stripping agent comprises sodium periodate or potassium periodate.

15. The method according to claim 9 wherein one of said materials is a photoresist composed of 13% fish gelatin, 2% ammonium bichromate and 85% water, and wherein the associated stripping agent comprises sodium hydroxide.

16. The method according to claim 15 wherein said matrix comprises manganous carbonate and wherein sodium hydrosulfite is applied in solution with sodium hydroxide to temper any effect of said sodium hydroxide to reduce the light output of said electroluminescent materials when stimulated.

17. A method for use in the construction of a color display screen using electrodeposition of a plurality of phosphor materials onto a conductive layer on a substrate bearing said screen, comprising the forming and electrodeposition operations a), b), c) and d), followed by operations e) and f):

a) forming on said conductive layer a matrix surrounding first, second and third patterns phosphor deposition sites, b) photolithographically forming on said conductive layer on said first pattern of phosphor deposition sites a first material selectively strippable by a first agent, c) photolithographically forming on said conductive layer on said second pattern of phosphor deposition sites a second material strippable by a second agent but not significantly attacked by said first agent, d) electrodepositing a first phosphor material on said conductive layer on said third pattern of phosphor deposition sites, e) performing a first stripping of one of said first and second materials with the associated one of said first and second agents to reveal one of said first and second patterns of phosphor deposition sites within said matrix and performing a second electrodepositing of a second phosphor material within said revealed deposition sites, and f) stripping the other of said first and second materials with the other of said first and second agents to reveal the other of said first and second patterns of phospor deposition sites within said matrix and electrodepositing a third phosphor material within said other revealed deposition sites, whereby the said photolithographic forming operations are segregated from the phosphor material electrodepositing operations.

18. The method according to claim 17 wherein said insulative matrix comprises manganous carbonate.

19. The method according to claim 18 wherein one of said agents comprises sodium hydroxide, and wherein said screen is baked to oxidize said manganous carbonate.

20. The method according to claim 18 wherein one of said agents comprises a solution of sodium hydroxide, and wherein sodium hydrosulfite is included in said solution to temper any effect of said sodium hydroxide to reduce the light output of said phosphor materials when stimulated.

21. The method according to claim 17 wherein said second material comprises polyvinyl alcohol photosensitized with ammonium dichromate, sodium dichromate or potassium dichromate, and wherein the associated stripping agent comprises hydrogen peroxide.

22. The method according to claim 17 wherein said first material comprises polyvinyl alcohol photosensitized with 4-(phenylamino)-benzenediazonium sulfate (1:1) formaldehyde polymer, zinc chloride complex, and wherein the associated stripping agent comprises sodium periodate or potassium periodate.

23. The method according to claim 17 wherein said third material is a photoresist composed of 13% fish gelatin, 2% ammonium bichromate and 85% water, and wherein the associated stripping agent comprises a solution of sodium hydroxide.

24. The method according to claim 23 wherein said matrix comprises manganous carbonate and wherein sodium hydrosulfite is included in said solution to temper any effect of said sodium hydroxide to reduce the light output of said phosphor materials when stimulated.

25. The method according to claim 17 wherein said matrix is electrically insulative and light absorptive as formed.

26. The method according to claim 17 wherein said matrix is electrically conductive and light absorptive as applied, and is overcoated with an electrically insulative layer prior to said electrodepositing of said first phosphor material.

27. The method according to claim 17 wherein said matrix is formed by an evaporation process.

* * * * *